US010309230B2

(12) United States Patent
McCaffrey

(10) Patent No.: US 10,309,230 B2
(45) Date of Patent: Jun. 4, 2019

(54) CO-FORMED ELEMENT WITH LOW CONDUCTIVITY LAYER

(71) Applicant: UNITED TECHNOLOGIES CORPORATION, Hartford, CT (US)

(72) Inventor: Michael G McCaffrey, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 667 days.

(21) Appl. No.: 14/773,945

(22) PCT Filed: Dec. 30, 2013

(86) PCT No.: PCT/US2013/078187
§ 371 (c)(1),
(2) Date: Sep. 9, 2015

(87) PCT Pub. No.: WO2014/143364
PCT Pub. Date: Sep. 18, 2014

(65) Prior Publication Data

US 2016/0017723 A1 Jan. 21, 2016

Related U.S. Application Data

(60) Provisional application No. 61/781,959, filed on Mar. 14, 2013.

(51) Int. Cl.
*B28B 1/24* (2006.01)
*F01D 5/14* (2006.01)
(Continued)

(52) U.S. Cl.
CPC ..... *F01D 5/282* (2013.01); *B28B 1/24* (2013.01); *F01D 5/147* (2013.01); *F01D 5/225* (2013.01);
(Continued)

(58) Field of Classification Search
CPC . F01D 15/02; F01D 25/24; F01D 5/30; F01D 25/08; F01D 5/18; F01D 9/02; F02C 7/24
(Continued)

(56) References Cited

U.S. PATENT DOCUMENTS 4,207,029 A * 6/1980 Ivanko ..... F01D 5/3084 416/220 R
4,460,311 A * 7/1984 Trappmann ..... F01D 11/12 415/116
(Continued)

FOREIGN PATENT DOCUMENTS

EP 1367223 A2 12/2003
EP 2540965 1/2013
(Continued)

OTHER PUBLICATIONS

European Office Action dated Jul. 20, 2018 issued in corresponding European Patent Application No. 13877597.8.

*Primary Examiner* — Mark A Laurenzi
*Assistant Examiner* — Mickey H France
(74) *Attorney, Agent, or Firm* — Bachman & LaPointe, P.C.

(57) ABSTRACT

A co-formed element includes a core structure which has a root portion and is formed from a high thermal conductivity ceramic matrix composite material, and a low thermal conductivity layer co-formed with the core structure and surrounding the root portion of the core structure.

5 Claims, 3 Drawing Sheets

(51) Int. Cl.

| | |
|---|---|
| ***F01D 5/22*** | (2006.01) |
| ***F01D 5/28*** | (2006.01) |
| ***F01D 5/30*** | (2006.01) |
| ***F01D 9/04*** | (2006.01) |

(52) U.S. Cl.
CPC ..... *F01D 5/28* (2013.01); *F01D 5/284* (2013.01); *F01D 5/3007* (2013.01); *F01D 5/3092* (2013.01); *F01D 9/041* (2013.01); *F05D 2220/32* (2013.01); *F05D 2230/30* (2013.01); *F05D 2230/51* (2013.01); *F05D 2260/231* (2013.01); *F05D 2300/2261* (2013.01); *F05D 2300/2283* (2013.01); *F05D 2300/6033* (2013.01)

(58) Field of Classification Search
USPC ..... 415/904
See application file for complete search history.

(56) References Cited

U.S. PATENT DOCUMENTS

| | | | | |
|---|---|---|---|---|
| 4,738,902 | A | 4/1988 | Prewo et al. | |
| 4,921,405 | A | 5/1990 | Wilson | |
| 5,846,054 | A | 12/1998 | Mannava et al. | |
| 6,696,144 | B2 | 2/2004 | Holowczak et al. | |
| 6,733,907 | B2 | 5/2004 | Morrison et al. | |
| 6,758,653 | B2 | 7/2004 | Morrison | |
| 8,114,799 | B2 | 2/2012 | Subramanian et al. | |
| 2003/0027012 | A1 | 2/2003 | Spitsberg et al. | |
| 2005/0084379 | A1 | 4/2005 | Schreiber | |
| 2008/0220240 | A1* | 9/2008 | Schmidt | C04B 41/009 428/312.8 |
| 2009/0016890 | A1 | 1/2009 | Douguet et al. | |
| 2012/0275898 | A1 | 11/2012 | McCaffrey et al. | |
| 2012/0328415 | A1* | 12/2012 | Blanchard | F01D 5/225 415/119 |
| 2013/0004325 | A1 | 1/2013 | McCaffrey et al. | |
| 2013/0011271 | A1 | 1/2013 | Shi et al. | |

FOREIGN PATENT DOCUMENTS

| | | | |
|---|---|---|---|
| JP | 110030103 | | 2/1999 |
| JP | H1130103 | A | 2/1999 |
| WO | 9964726 | A2 | 12/1999 |

* cited by examiner

CO-FORMED ELEMENT WITH LOW CONDUCTIVITY LAYER

BACKGROUND

The present disclosure is directed to a co-formed element having a core structure formed from a high thermal conductivity ceramic matrix composite material and a low thermal conductivity layer.

Gas turbine engines operate over a large temperature range. The internal flowpath is exposed to high gas pressures, velocities and temperature variations. Additionally, gas turbine engines are capable of accelerating and decelerating very quickly. The net result is flowpath exposed parts, such as blades, vanes, and shrouds can see large transient heat loads. High thermal conductivity (hi-K) ceramic matrix composites (CMC) are required to quickly dissipate the transient thermal gradients, and reduce the transient thermal stresses.

Parts made from CMC materials offer the ability to operate at temperatures above the melting temperature of their metallic counterparts. For hi-K CMC's, heat conduction into a metallic attachment part could overheat the metal in the attachment part. In these situations, the metal attachment part may have to be cooled, even though the CMC part does not require cooling. Adding cooling flow could create damaging local thermal gradients in the CMC part.

SUMMARY

There is provided in accordance with the present disclosure, an element which broadly comprises a core structure which has a root portion and is formed from a high thermal conductivity ceramic matrix composite material; and a low thermal conductivity layer co-formed with the core structure and surrounding the root portion of the core structure.

In another and alternative embodiment, the core structure is a turbine blade.

In another and alternative embodiment, the core structure is a vane.

In another and alternative embodiment, the core structure is a shroud.

In another and alternative embodiment, the low thermal conductivity layer includes a platform.

In another and alternative embodiment, the high thermal conductivity ceramic matrix composite material comprises silicon carbide fiber in a fully densified silicon carbide matrix material having a residual porosity of less than 10%.

In another and alternative embodiment, the residual porosity is less than 5.0%.

In another and alternative embodiment, the low thermal conductivity layer is formed from silicon carbide fibers in a matrix material.

In another and alternative embodiment, the low conductivity matrix material is selected from the group consisting of a silicon nitride, silicon-nitrogen-carbon material, at least one glassy material, or a combination thereof dispersed in a silicon carbide matrix.

Further in accordance with the present disclosure, there is provided a gas turbine engine system which broadly comprises a metal support structure, and a co-formed element having a core structure formed from a high thermal conductivity ceramic matrix composite material and an attachment layer formed from a low thermal conductivity ceramic matrix composite material surrounding a root portion of the core structure and contacting the metal support structure.

In another and alternative embodiment, the core structure is a turbine blade and the metal support structure is a disk.

In another and alternative embodiment, the core structure is a vane and the metal support structure is a metal hook.

In another and alternative embodiment, the core structure is a shroud.

In another and alternative embodiment, the attachment layer has a platform structure.

In another and alternative embodiment, the high thermal conductivity ceramic matrix composite material comprises silicon carbide fiber in a fully densified silicon carbide matrix material having a residual porosity of less than 10%.

In another and alternative embodiment, the residual porosity is less than 5.0%.

In another and alternative embodiment, the low thermal conductivity layer is formed from silicon carbide fibers in a matrix material.

In another and alternative embodiment, the low thermal conductivity matrix material is selected from the group consisting of a silicon nitride material, silicon-nitrogen-carbon material, at least one glassy material, and combination of these materials dispersed in a silicon carbide matrix.

Further in accordance with the present disclosure, there is provided a process for forming a co-formed element which broadly comprises the steps of placing a core structure formed from a fully densified, high thermal conductivity ceramic matrix material having a residual porosity of less than 10% into a mold, placing a three dimensional woven material into the mold so that the three dimensional woven material surrounds a root portion of the core structure, injecting a matrix material into the mold so that the three dimensional woven material is infiltrated with the matrix material; and allowing the matrix material to solidify to form the co-formed element.

In another and alternative embodiment, the residual porosity is less than 5.0%.

In another and alternative embodiment, the injecting step comprises injecting a matrix material selected from the group consisting of a silicon nitride material, at least one glassy material, a silicon-nitrogen-carbon material, and a combination of the materials dispersed in a silicon carbide matrix.

In another and alternative embodiment, the process further comprises forming the core structure from silicon carbide fiber in a silicon carbide matrix material.

In another and alternative embodiment, the process further comprises forming the three dimensional woven material from silicon carbide fibers.

Other details of the co-formed element with a low conductivity layer is set forth in the following detailed description and the accompanying drawing wherein like reference numerals depict like element.

DETAILED DESCRIPTION

There are a number of turbine engine components which come into contact with a metallic support structure. For example, turbine blades are mounted to a metallic rotor disk typically formed from a nickel based alloy. Similarly, vanes and shrouds are mounted to hooks formed from a metallic material.

In order to avoid the transfer of heat from the turbine engine component to the metallic support structure, it is proposed to form the turbine engine component, such as a turbine blade, vane or shroud, with a core structure formed from a strong hi-K (high thermal conductivity) CMC material, and co-form a low thermal conductivity (low-K) CMC insulating layer which surrounds those surfaces of the core structure that interact with the metallic support structure, such as a nickel-alloy disk, a case, or a support.

Figure 1:
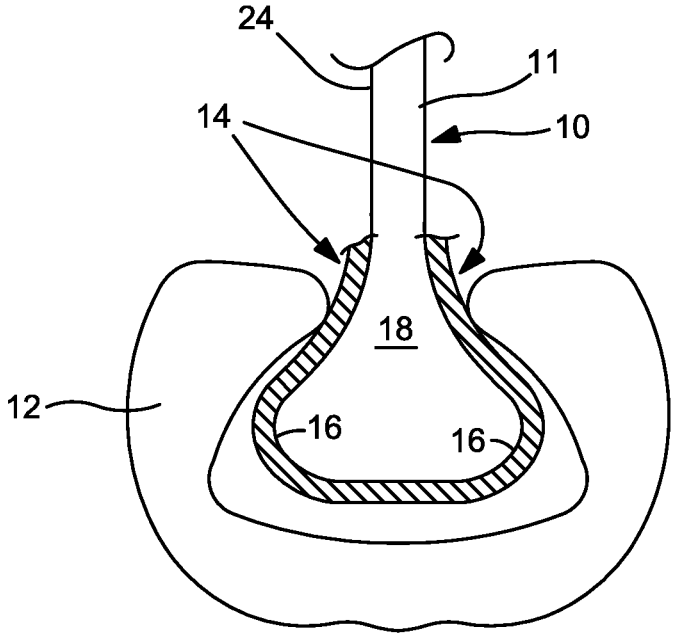
FIG. 1 is a schematic representation of a turbine blade having a high thermal conductivity ceramic matrix composite material core structure and a low thermal conductivity layer.

Referring now to FIG. 1, there is shown a turbine blade 10 which is to be mounted to a metallic rotor disk 12. The turbine blade 10 has a core structure 11 which may be formed from a hi-K CMC such as silicon carbide fiber (SiC) in a fully densified silicon carbide (SiC) matrix (SiC/SiC) material having a residual porosity of less than 10%. In a non-limiting embodiment, the residual porosity may be of less than 5.0%. The core structure 11 may have an airfoil portion 24. The metallic rotor disk 12 may be formed from a nickel based alloy.

In order to minimize the transfer of heat from the turbine blade 10 to the disk 12, an attachment layer 14 is co-formed around the surfaces 16 of the turbine blade 10 that interact with the metallic disk 12. The surfaces 16 are located in the root portion 18 of the core structure 11. The attachment layer 14 is formed from a low-K CMC material and has a thickness in the range of from 0.02 inches to 0.06 inches. The low-K CMC material may be formed from a three dimensional woven material. A suitable low-K CMC material which may be used for the attachment layer 14 is a material having SiC fibers in a silicon nitride (Si3N4), silicon-nitrogen-carbon (SiNC) or a glassy matrix. Alternatively, the silicon nitride, silicon-nitrogen-carbon (SiNC), and/or at least one glassy material may be combined and added to the SiC matrix to lower its thermal conductivity. In a non-limiting embodiment, the low-K CMC material forming the attachment layer 14 should have a thermal conductivity of less than one-tenth of the thermal conductivity of the metal material forming the disk 12.

Figure 2:
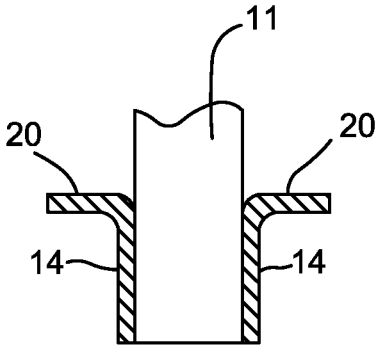
FIG. 2 is a schematic representation of the low thermal conductivity layer of FIG. 1 having a platform structure.

As can be seen from FIG. 1, the attachment layer 14 surrounds a root portion 18 of the core structure 11. If desired, as shown in FIG. 2, the attachment layer 14 may include a platform structure 20. The platform structure 20 may be in the form of a three dimensional (3D) woven material infiltrated by a matrix material. As described below, the attachment layer 14 is co-formed with the core structure 11.

Figure 3:
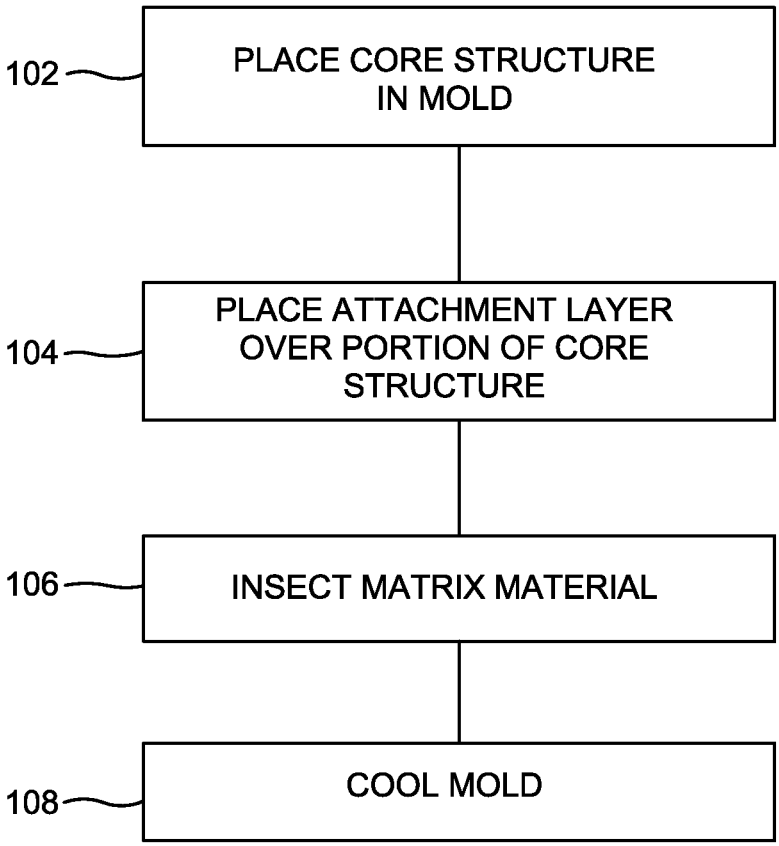
FIG. 3 is a flow chart showing the process of forming the turbine blade of FIG. 1.

To form a turbine blade 10 with an insulating attachment layer 14, the process shown in FIG. 3 may be used. As shown in step 102, a fully densified, melt infiltration (MI) SiC/SiC core structure 11, having a residual porosity of less than 10%, in the form of a turbine blade 10 may be placed in a mold. If desired, the residual porosity may be less than 5.0%. In step 104, the woven 3D fibers of the attachment layer 14, which can have a 3D woven platform structure 20 forming part of the attachment layer 14, are placed over a portion of the core structure 11 including the blade root portion 18. In step 106, a matrix material, such as glass, is injected into the mold using a glass—transfer process. The attachment layer is thus infused with the matrix material. In step 108, the mold is allowed to cool. As a result, the matrix material solidifies and a fully, co-formed CMC turbine blade 10 is created with a low-K attachment layer 14 and a hi-K core structure having an airfoil portion 24.

In another and alternative embodiment, in step 106, a matrix precursor material, such as Si3N4 and/or SiNC, or in combination with SiC matrix precursor material, is injected into the mold using a resin transfer process. The attachment layer is thus infused with the matrix precursor material. The material is heated and the matrix precursor is converted into the matrix material. In step 108, the mold is allowed to cool. As a result, the matrix solidifies and a fully co-formed CMC turbine blade 10 is created with a low-K attachment layer 14 and a high-K core structure 11 having an airfoil portion 24.

In another and alternative embodiment, in step 106, a matrix material, such as Si3N4 and/or SiNC is deposited into the woven fibers in the mold using a chemical vapor infiltration (CVI) process. The attachment layer is thus infused with the matrix material. In step 108, the mold is allowed to cool. As a result, the matrix has formed a fully, co-formed CMC turbine blade 10 created with a low-K attachment layer 14 and a high-K core structure having an airfoil portion.

Figure 4:
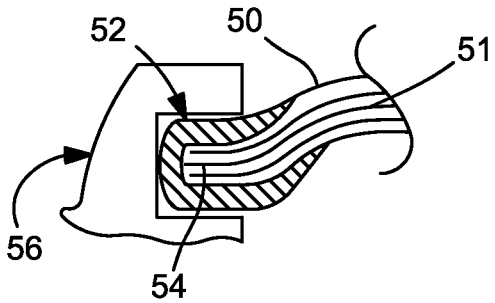
FIG. 4 is a schematic representation of a turbine engine component having a thermal conductivity ceramic matrix composite material core structure and a low thermal conductivity layer.

Referring now to FIG. 4, there is illustrated, a turbine engine component 50 such as a vane or a shroud, an attachment layer 52 surrounding a root portion 54 of the turbine engine component 50, and a metal support 56, such as a metal hook, for securing the turbine engine component 50 in position. The turbine engine component 50 has a core structure 51 which may be formed from a high-K CMC material such as a fully densified, melt infiltration SiC fiber in a SiC matrix material having a residual porosity of less than 10%. In another and alternative embodiment, the residual porosity is less than 5.0%. The attachment layer 52 may be formed from a low-K CMC material. The attachment layer 52 may include a platform structure if needed. The attachment layer may be formed from a woven three dimensional (3D) SiC fiber material in a matrix material selected from the group consisting of silicon-nitrogen-carbon (SiNC) and a glassy matrix.

Figure 5:
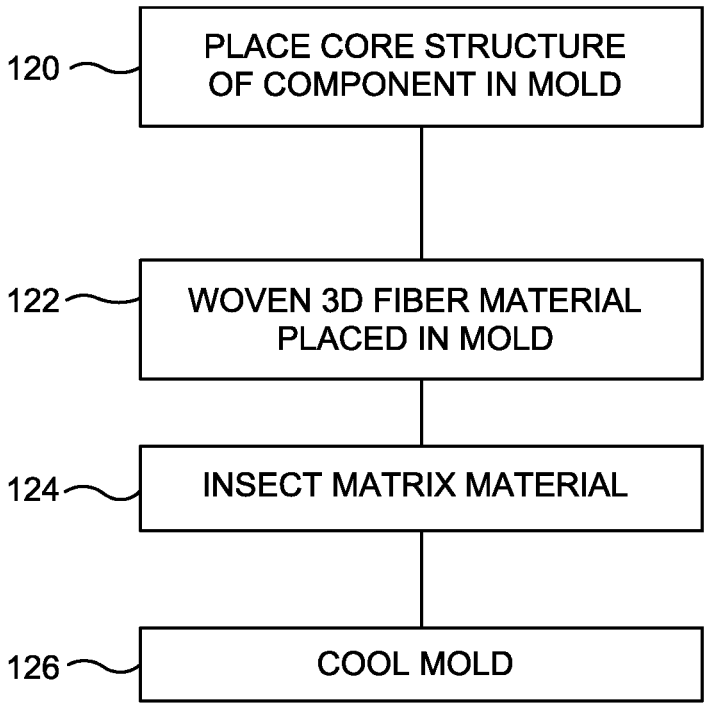
FIG. 5 is a flow chart showing the process of forming the turbine engine component of FIG. 4.

Referring now to FIG. 5, as shown in step 120, the core structure 51 of the turbine engine component 50, formed from the high-K CMC material, is placed into a mold. In step 122, the woven three dimensional fiber material is placed in the mold and positioned around the root portion 54 of the core structure 11 to cover all attachment surfaces with the metal support 56. In step 124, a matrix material, such as at least one glass material, is injected into the mold. This causes a hook region 60 of the attachment layer 52 to be locally infused with the matrix material. In step 126, the mold is allowed to cool. As a result, the matrix material solidifies and a fully, co-formed CMC turbine engine component 50 is created with the desirable characteristic of a low-K contact point with the metal support 56.

Alternatively in step 124, a matrix precursor material, such as Si3N4 and/or SiNC or a combination with SiC matrix precursor, is injected into the mold using a resin transfer process. The attachment layer is thus infused with the matrix precursor material. The material is heated and the matrix precursor is converted into the matrix material. In step 126, the mold is allowed to cool. As a result, the matrix solidifies and a fully, co-formed CMC turbine engine component 50 is created with the desirable characteristic of a low-K contact point with the metal support 56.

In another alternative embodiment, in step 124, a matrix material, such as Si3N4 and/or SiNC is deposited into the woven fibers in the mold using a chemical vapor infiltration (CVI) process. The attachment layer is thus infused with the matrix material. In step 126, the mold is allowed to cool. As a result, the matrix has formed a fully co-formed CMC turbine engine component 50 created with the desirable characteristics of a low-K contact point with the metal support 56.

The presence of the low thermal conductivity attachment layer 14 or 52 helps break the conduction path from the high-K CMC core structure of the particular component to the metallic support structure. Compared to a thermal barrier coating, a glassy CMC used for the attachment layer has equal strength to the high thermal conductivity CMC core structure. Thus, no structural penalty is created by using the low-K attachment layer 14 or 52.

There has been provided a co-formed element with a low thermal conductivity layer. While the co-formed element with a low thermal conductivity layer has been described in the context of specific embodiments thereof, other unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. A process for forming a co-formed element comprising the steps of:

placing a core structure formed from a fully densified, high thermal conductivity ceramic matrix material having a residual porosity less than 10% into a mold;

placing a three dimensional woven material into said mold so that said three dimensional woven material surrounds a root portion of said core structure;

injecting a matrix material into said mold so that said three dimensional woven material is infiltrated with said matrix material; and allowing said matrix material to solidify to form said co-formed element.

2. The process of claim 1, wherein said residual porosity is less than 5.0%.

3. The process of claim 1, wherein said injecting step comprises injecting a matrix material selected from the group consisting of a silicon nitride material, at least one glassy material, a silicon-nitrogen-carbon material, and combinations thereof in a silicon carbide matrix.

4. The process of claim 1, further comprising forming said core structure from silicon carbide fiber in a silicon carbide matrix material.

5. The process of claim 1, further comprising forming said three dimensional woven material from silicon carbide fibers.

* * * * *